US006188386B1

(12) United States Patent
Hayashi et al.

(10) Patent No.: US 6,188,386 B1
(45) Date of Patent: Feb. 13, 2001

(54) DATA CONVERSION APPARATUS AND IMAGE GENERATION APPARATUS

(75) Inventors: Hiroshi Hayashi, Kanagawa; Junichi Fujita, Saitama; Hiroyuki Ozawa, Kanagawa, all of (JP)

(73) Assignee: Sony Corporation, Tokyo (JP)

( * ) Notice: Under 35 U.S.C. 154(b), the term of this patent shall be extended for 0 days.

(21) Appl. No.: 09/205,202

(22) Filed: Dec. 4, 1998

(30) Foreign Application Priority Data

Dec. 8, 1997 (JP) ..... 9-337103

(51) Int. Cl.[7] ..... G09G 5/04; G09G 5/06

(52) U.S. Cl. ..... 345/153; 345/155; 345/199; 345/430; 345/431

(58) Field of Search ..... 345/154, 155, 345/199, 431, 501, 523, 430, 153, 150; 348/558, 714, 715, 448, 1.2

(56) References Cited

U.S. PATENT DOCUMENTS

| | | | | |
|---|---|---|---|---|
| 5,038,300 | | 8/1991 | Seiler et al. | 364/521 |
| 5,091,717 | * | 2/1992 | Carrie | 340/703 |
| 5,148,293 | * | 9/1992 | Miyachi | 358/444 |
| 5,442,379 | * | 8/1995 | Bruce | 345/199 |

FOREIGN PATENT DOCUMENTS

| | | |
|---|---|---|
| 0 184 246 | 6/1986 | (EP) . |
| 2 231 245 | 11/1990 | (GB) . |
| 89/00744 | 1/1989 | (WO) . |
| 92/157876 | 10/1992 | (WO) . |
| 93/04461 | 3/1993 | (WO) . |

OTHER PUBLICATIONS

"Color Pallette Expansion Technique for a Windowed Environment"; IBM Technical Disclosure Bulletin, US, IBM Corp., New York, vol. 34, No. 7B; Dec. 1, 1991pp. 40–42.
"Look–Up–Table Configuration"; IBM Technical Disclosure Bulletin, US, IBM Corp., New York, vol. 37, No. 2B, Feb. 1, 1994 pp. 471–472.

* cited by examiner

*Primary Examiner*—Mark R. Powell
*Assistant Examiner*—Wesner Sajous
(74) *Attorney, Agent, or Firm*—Ronald P. Kananen; Rader, Fishman & Grauer

(57) ABSTRACT

A data conversion apparatus for converting index data to real data and an image generation apparatus for converting index texture data to real texture data by the data conversion to make it possible to suitably carry out texture mapping. A data conversion apparatus comprises a first memory and a second memory each for storing data having a n bit width and in which any data is stored, an address detecting means for detecting addresses of the first memory and the second memory based on input data, a data reading means for reading data stored at the detected addresses of the first memory and the second memory, a first data selecting means for selecting either of the data read from the first memory or the data read from the second memory, a data extending means for extending the selected data to data having a 2×n bits width, and a second data selecting means for selecting either of the first data formed by connecting the data output from the first memory and the data output from the second memory or the second data of the extended data.

7 Claims, 5 Drawing Sheets

| ADDRESS | DATA |
|---|---|
| 1 | 1198 |
| 2 | 2223 |
| 3 | 3121 |
| 4 | 4221 |
| 5 | 5117 |
| 6 | 6901 |
| 7 | 7330 |

FIG. 6

| COLOR MODE | 32-BIT PRECISION | 16-BIT PRECISION |
|---|---|---|
| 2-BIT INDEX | 64 | 128 |
| 4-BIT INDEX | 16 | 32 |
| 8-BIT INDEX | 1 | 2 |

DATA CONVERSION APPARATUS AND IMAGE GENERATION APPARATUS

BACKGROUND OF THE INVENTION

1. Field of the Invention

The present invention relates to a data conversion apparatus for converting index data to real data and to an image generation apparatus for converting, for example, index texture data to real texture data by the data conversion to make it possible to suitably carry out texture mapping.

2. Description of the Related Art

When storing a large amount of data such as, for example, image data in a computer or other processing apparatus, to make effective use of the limited storage region of the apparatus, it is preferable to reduce the amount of data stored. As a general method for reducing the amount of data for this purpose, there is the method of using index data.

In this method, actual data (hereinafter referred to as "actual data" or "real data") is given a number expressed by a smaller bit width than the data bit width. By storing data by such numbers, it is possible to store the data by a smaller amount of data than that by directly storing the actual data. The numbers given to the actual data are referred to as "indexes", and the data converted to a format referred to by indexes is referred to as "index data".

When using index data, it is necessary to store both a list establishing correspondence between the index data and the real data, that is, an index table and the data expressed by the index data in the processing apparatus. However, usually the decrease of the amount of data caused due to the use of the index data is overwhelmingly larger than the increase of the amount of data caused due to the storage of the index table, therefore the amount of data can be greatly reduced as a whole.

When the method of storage using index data is applied to image data, the image data is stored in the form of index-data inside the processing apparatus. When displaying the image data on a display or otherwise outputting the image data to the outside, the index data is converted to real data for output. The conversion of the index data to the real data must be carried out at a high speed in accordance with, for example, the speed of display of the display device. Therefore, usually this data conversion processing is frequently carried out by data conversion apparatus constituted by hardware.

Specifically, the data conversion apparatus is constituted by using, for example, a memory. When the index is input as an address, the converted real data is output as the output data.

An example of such a data conversion apparatus constituted by a memory is shown in FIGS. 1A and 1B.

FIG. 1A is a view of a data conversion apparatus constituted by a memory for converting 3-bit index data to 32-bit real data. The content of the index data stored in this memory is shown in FIG. 1B.

In a field of computer graphics, color image data consisting of a very large amount of data is processed, therefore processing by "index color" expressing color data using indexes is frequently utilized.

"Processing by index color" means processing which defines index color data of for example 4 bits, 8 bits, and 16 bits for real color data of 24 bits comprised by for example 8 bits each of R, G and B by the number of required specified colors, maintains an index table corresponding to the index color data, and converts index color data to real color data.

For processing using computer graphics, there are many applications where there are no problems in actual use even if used while limiting the number of colors. In such a case, processing by index color is being used even more.

A data conversion apparatus for converting this index color data to real color data at a high speed is referred to as a "color look-up table" since it converts color data.

When using such index data, the types of usable data are limited by the number of entries of the index table. However, in some applications, there are cases where it is desired to use a larger amount of data than the number of entries of the index table. Therefore, in such a case, the methods of rewriting the index table for use or providing a plurality of index tables and using the same by switching in accordance with the situation are usually used. The method of rewriting of the index table, however, causes a reduction in the processing speed by an amount corresponding to the rewriting time. Therefore, in general the method of providing many index tables within a range allowed by the storage region of the memory of the data conversion apparatus is adopted.

Even if a plurality of index tables are provided due to such a method, there is no change in the fact that the types of data which can be used at each point of time are limited by the number of entries of the selected index table, but by providing many index tables and using them by appropriately switching in a series of continuous processing, substantially a large amount of data is used when seen from the standpoint of the application.

In this way, in processing by index data, provision of many index tables is becoming one of the most important factors in actual use.

Further, when using such index data, the bit width of the data output from the index table, that is, the precision of the index table, is also becoming important.

The requests on the data precision of an index table differ according to application. There are a variety of requests. For example, some require data precision, while others do not. When taking as an example the field of computer graphics, in CADs for graphic design, for example, the ability to display fine differences in the tone of colors is very important for designers and a high precision is required for the data of the index table. In the case of CADs for mechanical design, however, it is sufficient so far as parts can be discriminated by color and fine differences of colors of individual parts are not so important.

In this way, in processing using index data, the number of entries and the precision of the index table are very important items.

In the data conversion apparatuses heretofore, however, there has been a one-to-one correspondence between entries and addresses of the memory. The precision of the index table has corresponded to the data bit width of the memory and has been substantially fixed, so could not be adjusted corresponding to the application etc.

For this reason, there are many cases where the precision of the index table is set in advance so as to become a precision that can be also applied to applications for which a relatively high precision is required. Namely, in many cases each data has a certain longer bit width. As a result, even in a case of use with an application where not that high a precision is required, the processing is carried out with an index table having a precision of more than required.

Further, the number of entries is preferably made as large as possible, but an increase of the number of entries leads to an increase of the capacity of the memory which ends up being used. Therefore usually it cannot be sufficiently increased in many cases.

Namely, in the data conversion apparatuses heretofore, there tended to be the disadvantage that the number of entries was not sufficient despite the unnecessarily high precision etc., so there was a disadvantage in that it was difficult to effectively use the memory and carry out the processing using suitable indexes for the application.

As a result, in various processing apparatuses to which such a data conversion apparatus is applied, there has been a disadvantage in that suitable processing could not be carried out.

For example, when this data conversion apparatus is applied to processing for generating an image etc., the disadvantages having arisen that the number of usable colors has not been sufficient and therefore discrimination by color could not be suitably achieved and that the display of fine tones of color was not possible and therefore the desired image could not be displayed.

SUMMARY OF THE INVENTION

An object of the present invention is to provide a data conversion apparatus that can suitably change the precision of the index table with respect to an entry and the number of entries according to need and that can suitably carry out the conversion from index data to real data in a desired format suited to the application.

Further, another object of the present invention is to provide an image generation apparatus which can suitably change the precision of the index table with respect to an entry and the number of entries in accordance with the type of the image data to be processed etc., which can thereby convert from index color to real color in the desired format suited to the application, and which can suitably generate the intended image.

So as to achieve the objects, the present invention provides a data conversion apparatus comprising a first memory and a second memory each for storing data having a n bit width and in which any data is stored, an address detecting means for detecting addresses of the first memory and the second memory based on input data at which data corresponding to the input data are stored, a data reading means for reading data stored at the detected addresses of the first memory and the second memory, a first data selecting means for selecting either of the data read from the first memory or the data read from the second memory based on the input data, a data extending means for extending the selected data to data having a 2×n bits width, and a second data selecting means for selecting either of the first data formed by connecting the data output from the first memory and the data output from the second memory or the second data of the extended data based on an input selection signal and outputting data selected by the second data selecting means with respect to the input of the data.

Preferably, the address detecting means adds the input data and a predetermined base address to detect the address at which the corresponding data is stored.

Specifically, the first memory and the second memory store real color data, the address detecting means is input index color data given corresponding to real color data to be read, and the index color data is converted to real color data.

Further specifically, said real color data is data having red luminance data, green luminance data, blue luminance data, and transparency data.

Further specifically, the first memory and the second memory are memories each storing data having a 16 bits width, the real color data is 32 bits width data having 8 bits each of red luminance data, green luminance data, blue luminance data, and transparency data or 16 bits width data of 5 bits, 5 bits, 5 bits, and 1 bit, the data extending means extends the selected data to 32 bits width real color data when the read data is the 16 bits width real color data, and the second data selecting means selects the 32 bits width real color data formed by connecting the data output from the first memory and the data output from the second memory when the read data is 32 bits width real color data and selects the extended 32 bits width real color data when the read data is 16 bits width real color data.

Preferably, a data width of the input data is smaller than n bits.

Further preferably, the first memory, the second memory, the address detecting means, the data reading means, the first data selecting means, the data extending means, and the second data selecting means are comprised in an integrated circuit.

Further, so as to achieve the objects, the present invention provides an image generation apparatus comprising a coordinate transforming means for carrying out a predetermined coordinate transformation with respect to vertexes of basic polygons of three-dimensional image data by which any three-dimensional cubic model may be shown as a set of basic polygons indicated by vertexes having at least three-dimensional position information, a pixel data generating means for generating pixel data of the basic polygons based on the data of vertexes of the basic polygons, a data conversion apparatus which converts texture index data to real texture data for carrying out texture mapping with respect to the generated each pixel data, a texture mapping means for generating display use three-dimensional image data by carrying out texture mapping with respect to the generated pixel data by using the converted real texture data, an image memory for storing the generated three-dimensional image data as display use image data, and an outputting means for reading data of a desired region from among the stored display use image data and outputting the same as display use screen data, the data conversion apparatus comprising a first memory and a second memory each for storing data having n bits width and in which real texture data is stored, an address detecting means for detecting addresses of the first memory and the second memory based on input index texture data at which real texture data corresponding to the input index texture data are stored, a data reading means for reading real texture data stored at the detected addresses of the first memory and the second memory, a first data selecting means for selecting either of the real texture data read from the first memory or the real texture data read from the second memory based on the input index texture data, a data extending means for extending the selected data to data having a 2×n bits width, and a second data selecting means for selecting either of the first data formed by connecting the real texture data output from the first memory and the real texture data output from the second memory or the second data of the extended data based on an input selection signal and outputting real texture data with respect to the input of index texture data.

Preferably, the address detecting means adds the input index texture data and a predetermined base address of the index table to detect the address at which the real texture data is stored.

BRIEF DESCRIPTION OF THE DRAWINGS

These and other objects and features of the present invention will become clearer from the following description of the preferred embodiments given with reference to the attached drawings, in which:

FIG. 6 is a view of the number of color look-up tables which can be set in a memory unit of the color data conversion apparatus shown in FIG. 5.

DESCRIPTION OF THE PREFERRED EMBODIMENTS

A preferred embodiment according to the present invention will be explained below with reference to FIG. 2 to FIG. 6.

In the present embodiment, an explanation will be made of a case where the data conversion apparatus of the present invention is applied to a three-dimensional computer graphic system for displaying a desired three-dimensional image for any three-dimensional object model, such as applied to a computer game machine, on a display device at a high speed.

First, an explanation will be made of a three-dimensional computer graphic system to which the memory apparatus of the present invention is applied by referring to FIG. 2.

This three-dimensional computer graphic system is a system which carries out polygon rendering processing which expresses a cubic model as a combination of unit graphics, that is, triangles (polygons), draws the polygons, determines the color of each pixel of the displayed screen, and displays the same on a display.

Further, in the three-dimensional computer graphic system 1, a three-dimensional object is expressed by using a z-coordinate expressing the depth in addition to the (x, y) coordinates expressing the plane. Any point in three-dimensional space is specified by these three x-, y-, and z-coordinates.

Figures 1A, 1B:
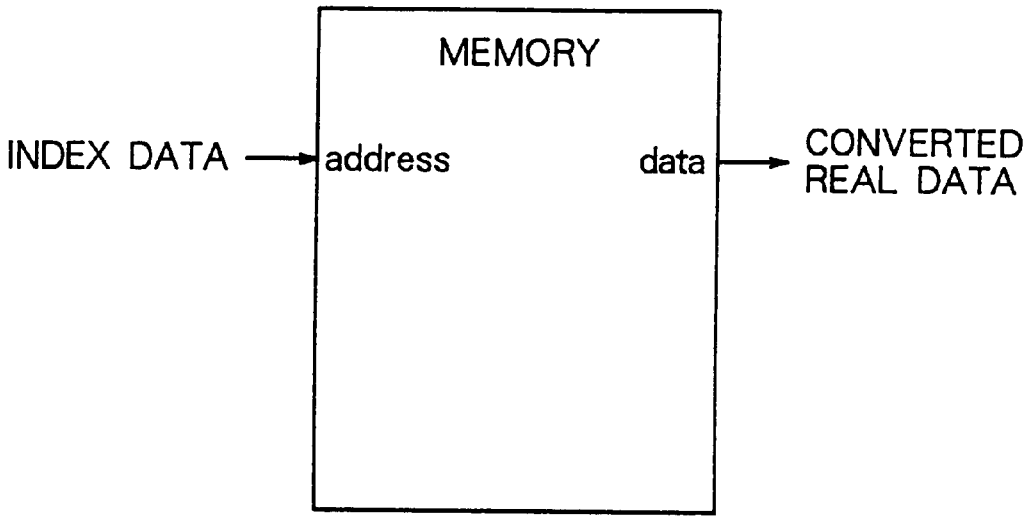
FIGS. 1A and 1B are views of the data conversion apparatus constituted by a memory as an example of a data conversion apparatus of the related art.
Figure 2:
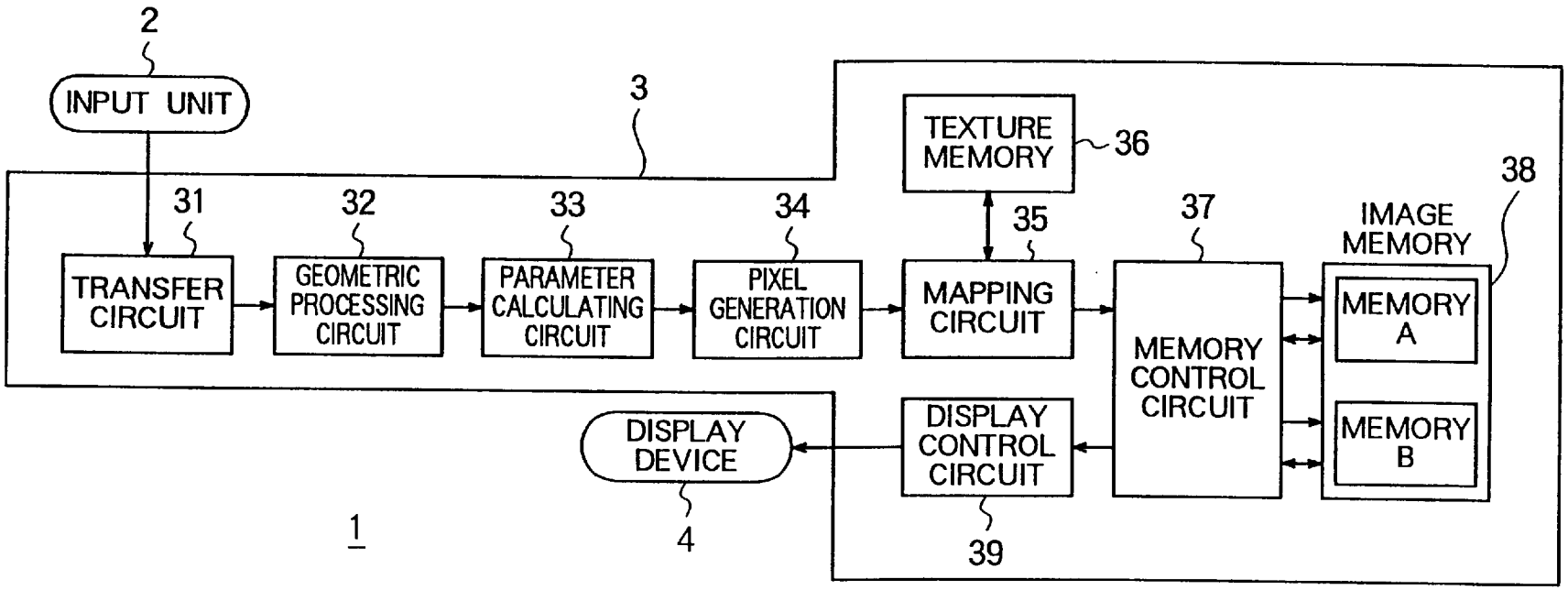
FIG. 2 is a block diagram of the configuration of a three-dimensional computer graphic system of an embodiment of the present invention.

FIG. 2 is a block diagram of the configuration of the three-dimensional computer graphic system 1.

The three-dimensional computer graphic system 1 has an input unit 2, a three-dimensional image generation apparatus 3, and a display device 4.

Further, the three-dimensional image generation apparatus 3 has a geometric processing circuit 32, a parameter calculating circuit 33, a pixel generation circuit 34, a mapping circuit 35, a texture memory 36, a memory control circuit 37, an image memory 38 and a display control circuit 39.

First, an explanation will be made of the structure and function of each unit.

The input unit 2 inputs the data of the cubic model to be displayed to the three-dimensional image generation apparatus 3. In the present embodiment, the three-dimensional computer graphic system 1 is applied to a computer game machine, therefore the input unit 2 is connected to a main control device etc. for controlling the game per se of the computer game machine. The main control device determines the screen to be displayed based on the state of progress of the game etc., selects the cubic model necessary for the screen display, and generates the information of the display method. Accordingly, the input unit 2 receives this information from the main control device of the computer game machine, converts the same to a format suitable for input to the three-dimensional image generation apparatus 3, and inputs this to the three-dimensional image generation apparatus 3.

Specifically, the input unit 2 inputs the polygon data of the cubic model to be displayed as mentioned above to the geometric processing circuit 32 of the three-dimensional image generation apparatus 3. Further, the polygon data input consists of x-, y-, and z-coordinate data of the vertexes and the color, transparency, texture, and other additional data.

The geometric processing circuit 32 arranges a polygon input from the input unit 2 at the desired position in the three-dimensional space and generates the polygon data at that position. Specifically, it carries out geometric transformation processing such as a parallel transference transformation, parallel transformation, and rotation conversion for every vertex (x, y, z) of a polygon. The polygon data subjected to the geometric transformation processing is output to the parameter calculating circuit 33.

The parameter calculating circuit 33 finds the parameters necessary for generating the pixel data inside a polygon in the pixel generation circuit 34 based on the data of the polygon input from the geometric processing circuit 32, that is, the data of each vertex of the polygon, and outputs the same to the pixel generation circuit 34. Specifically, it finds for example the information of the color, depth, and inclination of the texture.

The pixel generation circuit 34 carries out linear interpolation between vertexes of the polygon based on the polygon data subjected to the geometric transformation processing at the geometric processing circuit 32 and the parameters found at the parameter calculating circuit 33 and generates the pixel data of the internal portion of the polygon and an edge part. Further, the pixel generation circuit 34 generates an address on a predetermined two-dimensional plane corresponding to the display of the pixel data. The generated pixel data and addresses are sequentially input to the mapping circuit 35.

The mapping circuit 35 reads the pixel data and address generated at the pixel generation circuit 34 and carries out texture mapping processing with respect to the pixel data by using the texture data stored in the texture memory 36. The pixel data and addresses subjected to the texture mapping processing are output to the memory control circuit 37.

The texture memory 36 is a memory for storing a texture pattern used when carrying out the texture mapping at the mapping circuit 35. In the present embodiment, in this texture memory 36, the texture data is stored in the form of index data.

The memory control circuit 37 generates new pixel data based on the pixel data and address input from the mapping circuit 35 and the corresponding pixel data already stored in the image memory 38 and stores the same in the image memory 38. Namely, the memory control circuit 37 reads the pixel data corresponding to the address input from the mapping circuit 35 from the image memory 38, carries out the desired pixel operation processing by using this pixel data and the pixel data input from the mapping circuit 35, and writes the obtained pixel data into the image memory 38.

Further, the memory control circuit 37 reads the pixel data of the display region from the image memory 38 when the display region is designated from the display control circuit 39 and outputs the same to the display control circuit 39.

The image memory 38 is a memory for recording the image data for display and has two memory buffers which can be simultaneously accessed, i.e., a frame buffer and a Z-buffer. The frame buffer stores the color information of the pixels, that is, the frame data. Further, the Z-buffer stores the depth information (Z values) of the pixels, that is, the Z-data.

The display control circuit 39 converts the pixel data of the display region read from the image memory 38 via the memory control circuit 37 to for example predetermined analog signals which can be displayed by the display device 4, and outputs the same to the display device 4. Note that, preceding this, the display control circuit 39 requests the pixel data of the display region to be displayed to the memory control circuit 37.

The display device 4 is a television receiver having a video input terminal and so forth usually used in homes. From the display control circuit 39 of the three-dimensional image generation apparatus 3, an analog video signal is input via a video signal input terminal. A three-dimensional picture is displayed on the screen based on the signal.

Next, an explanation will be made of the operation of this three-dimensional computer graphic system 1.

First, in the main control device and so forth for controlling the game per se of the computer game machine, if the three-dimensional image to be displayed is determined, the information of the cubic model required for the screen display thereof is input to the input unit 2. The input unit 2 inputs the polygon data of the cubic model for displaying the image to the three-dimensional image generation apparatus 3 based on this information.

Each polygon data input to the three-dimensional image generation apparatus 3 is first subjected to geometric transformation processing such as parallel transference transformation, parallel transformation, and rotation transformation in the geometric processing circuit 32 so as to be arranged at a desired position in the three-dimensional space for the screen display.

Next, the parameters necessary for generating the pixel data inside the polygon are found in the parameter calculating circuit 33 with respect to the polygon data transformed in coordinates The pixel generation circuit 34 carries out linear interpolation between vertexes of the polygon and generates the pixel data of the internal portion of the polygon and the edge part.

The generated pixel data is sequentially input to the mapping circuit 35. The mapping circuit 35 converts the index data recorded in the texture memory 36, that is, the texture pattern data, to the real color data, carries out texture mapping processing by using this, and stores the generated pixel data in the image memory 38 via the memory control circuit 37.

The pixel data stored in the image memory 38 is suitably subjected to the desired processing based on other pixel data input by a similar route or any control data.

Due to this, the newest image data is always stored in the image memory 38 and supplied to the screen display. Namely, the request for output of the data of a predetermined region for display on the display device 4 is made from the display control circuit 39 to the memory control circuit 37. The pixel data of the region is suitably read from the image memory 38, converted to the predetermined signal for the screen display in the display control circuit 39, and output to the display device 4.

By this, the desired image is displayed on the screen of the display device 4.

Next, an explanation will be made of the color data conversion apparatus 100 according to the present invention by referring to FIG. 3A to FIG. 5.

The color data conversion apparatus 100 is accommodated in the mapping circuit 35 for the texture mapping processing of the three-dimensional image generation apparatus 3 of the three-dimensional computer graphic system 1 mentioned above. The mapping circuit 35 reads the texture data from the texture memory 36 and maps this to the pixel data input by the pixel generation circuit 34. As explained above, the texture data read from the texture memory 36 is stored as index color. Accordingly, the color data conversion apparatus 100 is provided for converting this index color to the real color and applying the same to the processing of the texture mapping.

First, the function of the color data conversion apparatus 100 will be explained in brief.

As explained above, the color data conversion apparatus 100 is an apparatus for converting index color data to real color data by referring to the index table (hereinafter referred to as a color look-up table).

As the index color data, use can be made of 2-bit, 4-bit, and 8-bit data.

A plurality of color look-up tables can be provided, and the table designated by indicating the base address.

As the real color data managed by the color look-up table, two index data having different precisions, that is, 16-bit data and 32-bit data, can be handled. The precision of the index data is selected by the mode signal "mode" of the precision of the index table.

Note that the data output from the color data conversion apparatus 100 is the 32-bit real color data.

Figure 3A:
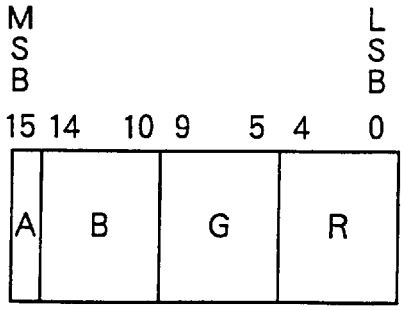
FIGS. 3A and 3B are views of formats of 16-bit and 32-bit real color data.
Figure 3B:
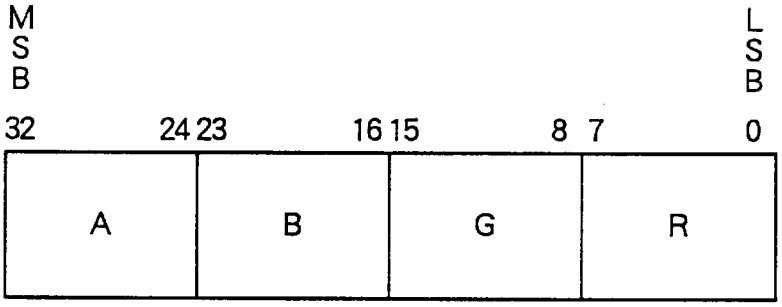

The formats of the 16-bit and 32-bit real color data are shown in FIGS. 3A and 3B.

As shown in FIG. 3A, the 16-bit real color data is structured, from the LSB side, of 5 bits of red luminance data R, 5 bits of green luminance data G, 5 bits of blue luminance data B, and one bit of transparency data A.

Further, as shown in FIG. 3B, the 32-bit real color data is structured of 8 bits each of red luminance data R, green luminance data G, blue luminance data B, and transparency data A arranged from the LSB side.

Next, an explanation will be made of the concrete structure of the color data conversion apparatus 100 by referring to FIG. 4 and FIG. 5.

Figure 4:
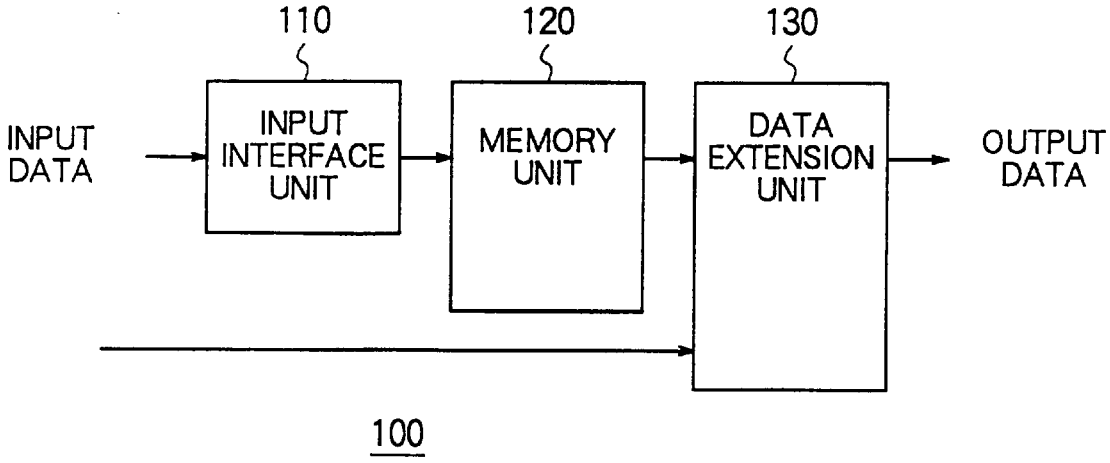
FIG. 4 is a block diagram for explaining the configuration of a color look-up table provided in a mapping unit of the three-dimensional computer graphic system shown in FIG. 2.

First, the structure of the color data conversion apparatus 100 will be briefly explained by referring to FIG. 4.

As shown in FIG. 4, the color data conversion apparatus 100 has an input interface unit 110, a memory unit 120, and a data extension unit 130 as fundamental structural units.

The input interface unit 110 picks out the required field from among the data read and input from the texture memory 36, extracts the index color data, and inputs the same to the memory unit 120.

The memory unit 120 accommodates the index table and converts the input index color to real color.

The data extension unit 130 extends the real color data read from the memory unit 120 to 32-bit full color data when it is 16-bit data and outputs the same.

Next, the structure of each unit of the color data conversion apparatus 100 will be explained in detail by referring to FIG. 5.

Figure 5:
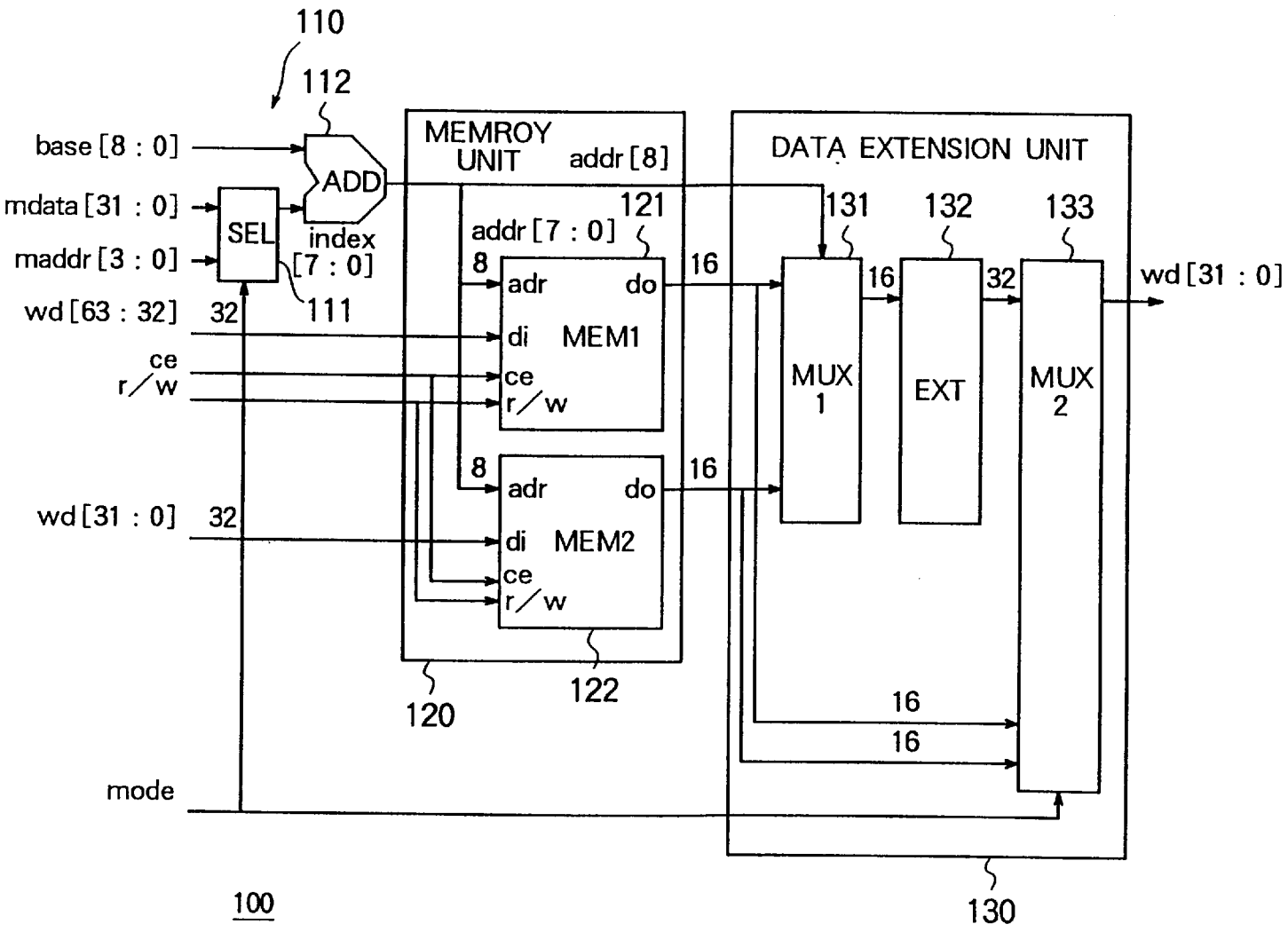
FIG. 5 is a detailed block diagram of the color look-up table shown in FIG. 4.

As shown in FIG. 5, the color data conversion apparatus 100 has a selector (SEL) 111 and an adder (ADD) 112 as the input interface unit 110, a first memory (MEM1) 121 and a second memory (MEM2) 122 as the memory unit 120, a first multiplexer (MUX1) 131, a data extender (EXT) 132, and a second multiplexer (MUX2) 133 as the data extension unit 130.

The selector 111 selects a valid part in 32 bits of data "mdata" read from the texture memory 36 based on the mode signal "mode" of the precision of the index table and the lower significant 4 bits "maddr" [3:0] of the data read from the texture memory 36, extends 0 to the upper significant bits according to need, generates the 8-bit index data "index", and outputs the same to the adder 112.

The adder 112 adds the base address "base" of the index table used and the value of the index data index input from the selector 111 to generate the 9-bit memory address "addr" [8:0] for designating the intended entry. The lower 8 bits "addr" [7:0] of the generated memory address are supplied to the first memory 121 and the second memory 122. The most significant data "addr" [8] is output to the first multiplexer 131 as the selection signal.

The first memory 121 and the second memory 122 are each 256 address×16-bit data SRAMs in which the color look-up tables are actually stored.

The first memory 121 and the second memory 122 store the color look-up tables via the 32-bit, thereby total 64-bit, input data lines WD.

Further, the data read from the first memory 121 and the second memory 122 are output to the first multiplexer 131 and the second multiplexer 133.

Note that when the mode of precision of the index table is the 16-bit mode, the storage regions of these first memory 121 and second memory 122 are allocated to different address spaces. The entire memory unit 120 becomes a storage unit having 512 address×16-bit structure. Accordingly, the number of index entries at this time becomes 512 entries.

Further, when the mode of precision of the index table is the 32-bit mode, the storage regions of the first memory 121 and the second memory 122 are allocated to the region of the upper significant 16 bits and the region of the lower significant 16 bits of the same address space, and the entire memory unit 120 becomes a storage unit having a 256 address×32-bit structure. Accordingly, the number of index entries at this time becomes 256 entries.

The first multiplexer 131 selects either of the 16-bit data input from the first memory 121 or the 16-bit data input from the second memory 122 based on the signal "adder" [8] of bit 8 of the memory address generated at the adder 112 and outputs the same to the data extender 132.

The data extender 132 extends the 16-bit data input from the first multiplexer 131 to 32-bit data and outputs the same to the second multiplexer 133.

The 16-bit real color data is comprised, as shown in FIG. 3A, of 5 bits of red luminance data R, 5 bits of green luminance data G, 5 bits of blue luminance data B, and one bit of transparency data A. The data extender 132 prepares 8-bit data for the luminance data R, G, and B by adding the data "d" [4:2] of the upper significant 3 bits to the LSB side of "d" to the 5-bit data "d" [4:0]. Further, for the transparency data A, it prepares 8-bit data with respect to the transparency data A=0 and 8-bit data with respect to the transparency data A=1 in advance and prepares the 8-bit data by replacing this by the 8-bit data based on the value of the transparency data A.

As a result, the 32-bit real color data of the format as shown in FIG. 3B.

The second multiplexer 133 selects either of the 32-bit data input from the data extender 132 or the 32-bit data consisting of the 16-bit data output from each of the first memory 121 and the second memory 122 based on the mode signal "mode" of precision of the index table and outputs the same as the output data from the color data conversion apparatus 100, that is, 32-bit real color data.

The second multiplexer 133 selects the output of the data extender 132 when the mode of precision of the index table is the 16-bit mode, while selects the outputs of the first memory 121 and the second memory 122 when it is the 32-bit mode.

The output data is input to the calculating circuit for carrying out the texture mapping of the mapping circuit 35.

Next, an explanation will be made of the operation of the color data conversion apparatus 100.

First, in the color data conversion apparatus 100, as the initial setup, the writing of the color look-up table to the first memory 121 and the second memory 122 is carried out.

The color look-up table is written by inputting the addresses via the selector 111, supplying the write data to the 64-bit input data line WD, switching the read/write control signal "r/w" to "write", and enabling the chip enable signal "ce".

When carrying out the data conversion, the read/write control signal "r/w" is set at "read", the mode "mode" of precision of the index table and the base address "base" of the index table to be used are designated, and then the lower significant bits of the data and the address read from the texture memory 36 are input to the selector 111.

Based on these input data and address, the index data "index" is generated at the selector 111 and added to the base address base at the adder 112, whereby the memory address "addr" is generated.

The lower 8 bits "addr" [7:0] of the generated address "ddr" are applied to the first memory 121 and the second memory 122, and the real data is read from the first memory 121 and the second memory 122.

When the mode of precision of the index table is the 32-bit mode, 32-bit real color data is output from the first memory 121 and the second memory 122, therefore they are output to the texture mapping processing circuit of the mapping circuit 35 as they are via the second multiplexer 133.

Further, when the mode of precision of the index table is the 16-bit mode, the data read from the first memory 121 and the second memory 122 are 16-bit real color data different from each other. Accordingly, either of the data output from the first memory 121 or the data output from the second memory 122 is selected at the first multiplexer 131 based on the most significant bit "addr" [8] of the address signal output from the adder 112 and is output to the data extender 132.

The 16-bit real color data input to the data extender 132 is extended to the 32-bit real color data by the method as mentioned above and output to the texture mapping processing circuit of the mapping circuit 35 via the second multiplexer 133.

Note that the number of entries of one color look-up table is determined by how many number of bits the index color data has. When 2-bit index colors are used, there are four index color values, i.e., 0, 1, 2, and 3, and there are four entries corresponding to this. Similarly, when 4-bit index colors are used, there are 16 entries in the color look-up table is 16, while when 8-bit index colors are used, there are 256 entries.

As the entire color data conversion apparatus 100, the memory unit 120 is constituted by two memories each consisting of 16 bits×256 addresses, therefore when the mode of precision of the index table to be used is the 16-bit mode, there are 512 entries, while when it is the 32-bit mode, there are 256 entries.

The number of color look-up tables which can be set in the memory unit 120 in accordance with the number of bits of the index color data and the mode of precision of the index table is shown in FIG. 6.

In this way, in the color data conversion apparatus 100 of the present embodiment, the number of bits of the index color data, that is, the precision of one color look-up table, and the number of entries can be selected according to necessity. Accordingly, the color look-up input can be constituted with the required precision and required number of entries in accordance with the type etc. of application, and suitable color data in accordance with the application can be generated.

Further, in the three-dimensional computer graphic system 1 of the present embodiment, at the time of texture mapping, the precision of the index table and the number of entries thereof can be suitably adjusted in accordance with the application. Accordingly, the desired color image can be obtained in accordance with the application, and the effective use of the memory and the enhancement of performances of the system by this become possible.

Note that the present invention is not limited to the present embodiment. Various modifications are possible.

For example, the data extension method in the data extender 132 of the data extension unit 130 can be any method. For example, a method of extension by entering a specific pattern such as 000 or 111 on the LSB side of each data can also be adopted.

Further, if the content of the color look-up table is fixed, it is also possible to constitute the first memory 121 and the second memory 122 of the memory unit 120 by ROMs. If they are constituted by ROMs, the color data conversion apparatus 100 can be made smaller in size.

Further, by entering various operation results in the memory unit 120, it is also possible to constitute a general purpose processor.

As explained above, if the data conversion apparatus of the present invention is used, the precision of the index table with respect to one entry and the number of entries may be appropriately changed according to need and the conversion from index data to real data can be suitably carried out in the desired format adapted to the application.

Further, according to the image generation apparatus of the present invention, in accordance with the type of the image data to be processed, etc., the precision of the index table with respect to one entry and the number of entries can be appropriately changed. Due to this, the conversion from index color to real color can be suitably carried out in the desired format adapted to the application, and the desired image can be suitably generated.

What is claimed is:

1. A data conversion apparatus comprising:

a first memory and a second memory each for storing data having a n bits width and in which any data is stored;

an address detecting means for detecting addresses of said first memory and said second memory based on input data at which data corresponding to said input data are stored;

a data reading means for reading data stored at said detected addresses of said first memory and said second memory;

a first data selecting means for selecting either of the data read from said first memory or the data read from said second memory based on said input data;

a data extending means for extending said selected data to data having a 2×n bits width; and a second data selecting means for selecting either of the first data formed by connecting the data output from said first memory and the data output from said second memory or the second data of said extended data based on an input selection signal and outputting data selected by said second data selecting means with respect to said input of the data.

2. A data conversion apparatus as set forth in claim 1, wherein said address detecting means adds said input data and a predetermined base address to detect the address at which said corresponding data is stored.

3. A data conversion apparatus as set forth in claim 2, wherein;

said first memory and said second memory store real color data, said address detecting means is input index color data given corresponding to real color data to be read, and the index color data is converted to real color data.

4. A data conversion apparatus as set forth in claim 3, wherein said real color data is data having red luminance data, green luminance data, blue luminance data, and transparency data.

5. A data conversion apparatus as set forth in claim 4, wherein;

said first memory and said second memory are memories each storing data having a 16 bits width, said real color data is 32 bits width data having 8 bits each of red luminance data, green luminance data, blue luminance data, and transparency data or 16 bits width data of 5 bits, 5 bits, 5 bits, and 1 bit, said data extending means extends said selected data to 32 bits width real color data when said read data is said 16 bits width real color data, and said second data selecting means selects the 32 bits width real color data formed by connecting the data output from said first memory and the data output from said second memory when said read data is 32 bits width real color data and selects said extended 32 bits width real color data when said read data is 16 bits width real color data.

6. A data conversion apparatus as set forth in claim 1, wherein a data width of said input data is smaller than n bits.

7. A data conversion apparatus as set forth in claim 1, wherein said first memory, said second memory, said address detecting means, said data reading means, said first data selecting means, said data extending means, and said second data selecting means are comprised in an integrated circuit.

* * * * *